US007762928B2

(12) United States Patent
Meissner

(10) Patent No.: US 7,762,928 B2
(45) Date of Patent: Jul. 27, 2010

(54) ARTIFICIAL ROCK CLIMBING SYSTEMS AND METHODS ADAPTED FOR WATER ENVIRONMENT

(76) Inventor: Richard K. Meissner, W288 N8433 N. Bay Rd., Hartland, WI (US) 53029

( * ) Notice: Subject to any disclaimer, the term of this patent is extended or adjusted under 35 U.S.C. 154(b) by 0 days.

(21) Appl. No.: 12/156,104

(22) Filed: May 29, 2008

(65) Prior Publication Data

US 2008/0300111 A1 Dec. 4, 2008

Related U.S. Application Data

(60) Provisional application No. 60/932,174, filed on May 30, 2007.

(51) Int. Cl.
*A63B 9/00* (2006.01)

(52) U.S. Cl. ..... 482/37; 482/35

(58) Field of Classification Search ..... 482/35–37, 482/148, 17, 51; 446/476; 472/134, 136
See application file for complete search history.

(56) References Cited

U.S. PATENT DOCUMENTS

| | | | | |
|---|---|---|---|---|
| 534,704 | A | 2/1895 | Worden | |
| 2,556,175 | A | 6/1951 | Frost | |
| 3,741,538 | A * | 6/1973 | Lewis et al. | 482/120 |
| 4,848,737 | A | 7/1989 | Ehrenfield | |
| 5,543,185 | A | 8/1996 | Christensen | |
| 6,083,142 | A * | 7/2000 | Wilson | 482/37 |
| 6,193,633 | B1 | 2/2001 | Jones et al. | |
| 6,231,482 | B1 | 5/2001 | Thompson | |
| 6,322,454 | B1 | 11/2001 | Gordon | |
| 6,390,952 | B1 * | 5/2002 | Wilson | 482/37 |
| 6,551,215 | B1 | 4/2003 | Gordon | |
| 6,872,167 | B1 * | 3/2005 | Meissner | 482/37 |
| 2002/0169052 | A1 * | 11/2002 | Godsey | 482/37 |
| 2003/0228956 | A1 * | 12/2003 | Paci | 482/37 |
| 2007/0142175 | A1 * | 6/2007 | Morgan et al. | 482/1 |
| 2008/0293546 | A1 | 11/2008 | Moy et al. | |

(Continued)

FOREIGN PATENT DOCUMENTS

| | | |
|---|---|---|
| WO | WO 9531257 | 11/1995 |

OTHER PUBLICATIONS

AquaClimb Product Line; Wall configuration for 5' minimum pool depth; product code AQCL-2H4W; copyright AquaClimb 2005; p. 1 (www.aquaclimb.com).

(Continued)

*Primary Examiner*—Fenn C Mathew
(74) *Attorney, Agent, or Firm*—Quarles & Brady LLP

(57) ABSTRACT

Improved climbing structures, systems, and methods for use on an artificial rock climbing arrangement which includes a generally rigid framework removably attached to a support surface located adjacent a body of water. The framework makes use of assist shocks in combination with actuators in order to provide an automated (motorized) easy-up vertical climbing wall. A panel structure is mounted on the framework for defining a climbing surface, the panel surface carrying a plurality of climbing holds. A hinged adjustable support bar is secured between the framework and the support surface for maintaining the framework and the climbing surface in a substantially vertical orientation when a climber scales the climbing surface. The hinged adjustable support bar is diagonally mounted with telescoping and threaded ends.

16 Claims, 8 Drawing Sheets

U.S. PATENT DOCUMENTS

| | | | | |
|---|---|---|---|---|
| 2008/0293547 | A1 | 11/2008 | Moy et al. | |
| 2008/0293548 | A1 * | 11/2008 | Moy et al. | 482/36 |

OTHER PUBLICATIONS

AquaClimb Product Line; Wall configuration for 7' minimum pool depth; product code AQCL-3H1W; copyright AquaClimb 2005; pp. 1-3 (www.aquaclimb.com).
AquaClimb Product Line; Wall configuration Image A; Sep. 21, 2005; p. 1 (www.aquaclimb.com).
AquaClimb Product Line; Wall configuration Image B; Sep. 21, 2005; p. 1 (www.aquaclimb.com).
AquaClimb Product Line; Wall configuration Image C; Sep. 22, 2005; p. 1 (www.climbpyramide.com).
AquaClimb Product Line; Wall configuration Image D; Sep. 21, 2005; p. 1 (www.climbpyramide.com).
U.S. Appl. No. 60/940,133, filed May 2007, Moy.
AquaClimb Product Brochure; Circa 2005; pp. 1-8.
AquaClimb Product Line Drawings; Orthographic Views; Aug. 2, 2006; p. 1.
AquaClimb Product Line Drawings; Sep. 22, 2005; pp. 1-4.

* cited by examiner

ARTIFICIAL ROCK CLIMBING SYSTEMS AND METHODS ADAPTED FOR WATER ENVIRONMENT

RELATED APPLICATIONS

This application claims the benefit of U.S. Provisional Patent Application Ser. No. 60/932,174, filed May 30, 2007, and entitled "Modified Artificial Rock Climbing Arrangement Adapted For Water Environment," which is incorporated herein by reference.

FIELD OF THE INVENTION

The present invention relates generally to recreational devices and, more particularly, pertains to the adaptation of an artificial rock climbing arrangement combined with water sports equipment.

BACKGROUND OF THE INVENTION

Both rock climbing and water sports have increased in popularity tremendously over the last few decades, and with this increase, artificial rock climbing walls and water sports equipment have become quite popular.

Artificial rock climbing walls allow climbers to practice and hone their skills, and allow beginners to experience rock climbing in a safe environment away from dangerous conditions such as high elevation, loose rocks, etc., that exist while climbing actual rock formations. In addition, artificial rock climbing walls allow purchasers of climbing boots, harnesses, and other equipment to test these articles in a store prior to purchase. Hence, artificial rock climbing walls are becoming commonplace for indoor gymnasiums, resorts, climbing equipment retail stores, and the like. In the past few years, water-based artificial rock climbing walls have begun to take root as a water sports activity, more particularly with residential swimming pools, high schools, colleges, community pools, and lake residents.

A typical artificial climbing structure will have modular panels constructed of plywood, fiberglass, or other composite material with T-nuts inserted through or molded in the panels. The T-nuts allow components called climbing holds to be affixed to the climbing surface in a manner which defines a climbing route. These climbing holds are often threadably fastened to the T-nuts so that the holds can be added, removed or changed to vary the features and difficulty of ascending the artificial wall. The climbing holds are typically made of resin-concrete, and can be shaped as desired. For example, an easy hold would provide a large external ledge, which is easily grabbed or stepped on. A more difficult hold will only extend slightly from the climbing surface, making it more difficult for the climber to support their weight. Today's climbing holds serve a functional, decorative and an entertainment purpose.

More recent advancements and climbing wall structures have enhanced the look and feel of the climbing surface. Textured fiberglass panels having molded features that more nearly approximate those of natural walls are also now available. The molded panels incorporate T-nuts or other hold attachments structures so that the difficulty of the various routes can be changed after the panels are assembled. Alternate artificial rock climbing structures make use of clear lexan polycarbonate for a see-through look. Yet other artificial rock climbing structures make use of specialized graphic designs to attract children and provide a means for subsidized advertising dollars. Hence, advancements to artificial climbing structures for use in a fixed location such as a climbing gym, climbing store and the like, have gradually enhanced these practice climbing facilities by providing realistic walls that closely approximate natural rock formations. In addition, advancements to artificial climbing structures in a water environment have enhanced water-parks, swimming pools, and lakes by providing a new water-sport device to swimmers.

As climbing has further increased in popularity, attempts have been made to provide portable climbing structures that can be set up for temporary use at fairs or other events. Also, many colleges, universities and resorts have built elaborate artificial rock climbing facilities.

Water based rock climbing walls, on the other hand, allow swimmers to enjoy rock climbing in a pool or lake environment where the water cushions your fall. Swimming ranks number one in sports participation rankings with over 90 million participants annually. Being conservative, water based climbing walls are expected to grow 20-25% per year fueled by today's young adults along with their passion for climbing. Hence, water based artificial rock climbing walls provide an optional activity for indoor and outdoor water-parks, community pools, private pools, resorts, swim clubs, recreation centers, and the like. Over the past several years community pools have been struggling to increase attendance, since teens are drawn to large theme and water parks. Water based rock climbing walls provide community pools with an economical solution to regain that lost attendance.

Water-based artificial rock climbing walls must be built and designed with numerous environmental concerns in mind, such as, salt water, fresh water, chlorinated water, wind, and the sun's damaging ultraviolet radiation. Obviously, salt water and chlorinated water are corrosive to all metallic components. Therefore, a protective coating may be required for steel, aluminum, and stainless steel. Examples of protective coatings may include, but are not limited to, paint, epoxy coating, powder coating, anodizing, and hard coating depending on the circumstances. Plastics, fiberglass, and other composites have very resilient qualities to the sun, salt, and chlorine.

Water sports, lake homes, and larger and more expensive water toys, such as trampolines, aluminum rafts, and specialized water ski equipment, have also increased in popularity. This is due in part to the substantial increase in valuations of lake homes and the growing importance of leisure time. In general, owners of lake homes feel wealthier and can justify the feeling of having more disposable income to enjoy their leisure activities.

A new trend appears to be in the hotel and indoor water-park combination. This trend is growing rapidly and is fueled by leisure travel patterns favoring the drive-to regional hotel resort. Hotels with indoor water-parks achieve a higher occupancy rate and higher revenue per room. Water based climbing walls along with slides, wave-pools, lazy rivers, water buckets, dark tunnels, drops, mat racers, and surf pools are just a few of the attractions offered at indoor water parks.

All across America there appears to be a growing health concern regarding obesity. It is said that today's parents are expected to outlive their children. Simply, children are lacking exercise. Water based climbing walls provide a new and exciting form of exercise. Children of all ages love to climb.

In light of the above, it would be desirable to provide improved artificial rock climbing systems and methods. It would be particularly desirable to provide climbing structures that were better suited for use with water sports activities keeping product evolution in mind. Similar to most product life cycles, there will be numerous improvements, betterments, and modifications as time goes on.

SUMMARY OF THE INVENTION

It is an object of the present invention to provide a water based artificial rock climbing arrangement which may include assist members, i.e., either or both assist shocks and/or power system for easy setup and teardown when mounted to an in-water or near water support surface.

It is a further object of the present invention to provide a water based artificial rock climbing arrangement which may include a removable water-start panel, and/or an anti-entrapment shield in order to provide climbers with an easier starting point, to minimize entrapment areas of the climbing wall, and to provide additional safety features.

It is a further object of the present invention to provide a water based artificial rock climbing arrangement which may include a removable anti-climb-over panel to eliminate over-the-top climbing and to provide additional safety features.

It is a further object of the present invention to provide a water based artificial rock climbing arrangement which may include adjustable and hinged support bars.

It is a further object of the present invention to provide a water-based artificial rock climbing arrangement with add-on accessories, such as, but not limited to, a removable climbing wall height extension panel, and a simulated water-fall sprinkler system.

In one aspect of the invention, an artificial rock climbing arrangement includes a generally rigid framework removably attached to a support surface located adjacent a body of water. Further details of representative constructions of an artificial rock climbing arrangement can be found in commonly owned U.S. Pat. No. 6,872,167, to Meissner, filed Mar. 1, 2002, which is incorporated herein by reference.

A climbing panel structure may be mounted on the framework for defining an artificial climbing surface, the panel structure carrying a plurality of climbing holds. A support structure is secured between the framework and the support surface for mounting the framework and the climbing surface in a substantially vertical orientation when a climber scales the climbing surface. The framework may have a variety of shapes including round, square, or an inverted U-shape, for example, and may include a pair of parallel legs connected together by a bight portion.

A modification to this invention may include an inner lip or C-channel securely attached to the inside edge of the parallel legs in order to slide in place or otherwise securely fasten the climbing panels. Also, the inverted U-shape may be replaced with just the pair of parallel legs supported by the panel system and sway bar supports.

In addition, the framework legs may have bottom ends provided with mounting devices removably secured to an end of the support surface. In some embodiments, the mounting devices permit pivotable movement of the framework and the climbing surface relative to the support surface. In another embodiment, the mounting devices prevent pivotable movement of the framework and the climbing surface relative to the support surface. The support surface may take the form of a pier, pontoon boat, pool deck, or other suitable surfaces, such as, luxury yacht, deck boat, floating raft, cruise boat, house boat, etc. The framework and the climbing surface may be movable between a use position and a non-use position. The panel structure may be modular and includes one or more adjacently joined panels removably fastened to the framework. The framework can be made of various materials including, but not limited to steel, aluminum, extruded aluminum, and stainless steel. The framework may be coated with various materials including, but not limited to lacquers, enamels, powder coat, anodizing, hard coating, and epoxy for protection from the elements.

In an exemplary embodiment, the support structure may include a pair of diagonal support bars, each being connected between one leg of the framework and a connecting plate, square tube, or anchor system attached to the side or the top of the support surface behind the framework. Each connecting plate, square tube, or anchor system may allow for more than one position, one for holding the framework and climbing surface at an angle of generally 90 degrees relative to the support surface, and another for holding the framework and climbing surface at an angle beyond 90 degrees (e.g., between 90 degrees and 135 degrees, or greater) relative to the support surface. The support structure may also provide for linear movement to allow for different amounts of over-hang or under-hang of the complete framework in relation to the support surface edge in order to provide a universal mounting system.

Each mounting device may be comprised of a mounting plate, a tube, e.g., square or round, or anchor system attached to the edge or the top of the support surface. The mounting plate, square tube, or anchor system may include a pair of spaced apart tubular or flat stock receivers. A triangular or polygonal bracket or plate may be provided on or near the bottom of each framework leg and may have a tubular or flat stock knuckle disposed between the receivers on the mounting plate, square tube, or anchor system. A removable hinge pin may be passed through the aligned receivers and knuckle.

The diagonal support bars may consist of a hinge system to allow the entire framework to be in a folded down non-use position or a substantially vertical position. The hinge system having a pair of spaced apart flat stock receivers and knuckle securely attached to the diagonal support bar. The hinge pin may be non-removable for safety reasons. The hinge system may also contain a locking mechanism whereby the diagonal support bars would be locked in a fully extended and straight position when the entire framework is in a substantially vertical position. The locking mechanism may consist of a rounded or square shaped rod slideably inserted inside of both halves of the diagonal support bars. The rounded or square shaped rod may completely slide into one-half of the diagonal support bars when unlocked and may slide into both halves of the diagonal support bars when locked.

The diagonal support bars may consist of lengthwise adjustable ends. One end may be comprised of a threaded male and female component and the other end may be comprised of a male and female telescoping component. The threaded end may be used for small adjustments and the telescoping end may be used for large adjustments. Adjustments are required to align the hinge system, to allow for different climbing angles of the entire framework structure, and to provide a universal product which can be used for more than one type of installation.

An option includes a pair of assist shocks in combination with or without a pair of actuators in order to provide an automated (motorized) easy-up vertical climbing wall. One end of the assist shocks or actuators may be removably secured to the pair of parallel framework legs and the other end may be removably secured to the mounting plate, square tube, or anchor system, which is mounted on the support surface. The lifting means of the shocks or actuators may comprise of compressed gas, spring, hydraulic, compressed air, low or high voltage electric, or some other power system.

An additional option includes a removable water-start panel and/or a removable anti-climb-over panel may be installed in order to provide additional safety features. Each of these panels may consist of an independent framework, which will mate or unite with the pair of parallel framework legs. The independent framework of the anti-climb-over panel may be such that when attached to the pair of parallel framework legs, the angle of the panel may be substantially greater than that of the overall framework, thus making it impossible to climb over. In addition, the anti-climb-over panel may have no climbing holds attached to it. The independent framework of the anti-climb-over panel may be attached to the pair of parallel framework legs by telescoping or sliding inside of the framework legs and secured with a retaining pin and/or threaded tension bolt. The independent framework of the water-start panel may be such that when attached to the pair of parallel framework legs, the panel may be partially submerged in water, thus making it easier to begin the climb. Similarly, the independent framework of the water-start panel may be attached to the pair of parallel framework legs by telescoping or sliding inside of the framework legs and secured with a retaining pin and/or threaded tension bolt.

An additional option may include a sprinkler fitting that may be mounted to the top panel or framework providing for the added thrill of climbing in a simulated waterfall. A pump and hose system (not shown) may be mounted to the framework and support surface.

The rock climbing arrangement contemplates several different mounting devices, each of which provides for easy set-up and knock down by respective insertion and removal of hinge and retainer pins.

The entire invention or embodiment may be offered for sale as a kit, which can be installed by someone familiar with water-based rock climbing walls.

In addition, the entire invention or embodiment may comprise of a modular form whereby more than one embodiment may be placed along side another embodiment by modifying one of the framework legs, whereby two panel mount lips are affixed to each side of a framework leg allowing for panel mounts on both sides.

An additional option may include alternative shapes (e.g., partial or continuous non-linear) to the climbing wall surface, such as, but not limited to a C-Shape, S-Shape, or Inverted L-Shape. Obviously, there would be limitations placed on the shapes of the climbing wall surface due to safety concerns, manufacturing capabilities, and applied engineering and physics of climbing.

An additional option may include alternative fixed mounting systems and may include non-fixed mounting systems. The non-fixed mounting systems may include its own counter-weight to hold the wall and the weight of a climber in a generally vertical position. The non-fixed mounting system may eliminate the use of bolts or fasteners being attached to the support surface. The counter-weight may consist of a tank enclosure securely fastened to the base connecting plate, square tube, or other base support system located behind the framework legs. The tank enclosure may then be filled with water, sand, or other flow-based material to provide the necessary counter-weight. The tank enclosure may then be emptied of its contents allowing for easy mobility of the water-based artificial rock climbing arrangement. The tank enclosure may include a fill cap along with a discharge valve, or it may consist of a reversible pump system either mechanical or electrical in order to fill and empty the tank enclosure.

An additional option may include add-on accessories, such as, but not limited to a removable climbing wall height extension panel, or simulated water-fall sprinkler system. The removable climbing wall height extension panel may allow customers/users with the ability to increase the height of the climbing wall without incurring large costs associated with the purchase of a new climbing wall. Obviously, not all customers/users would be able to take advantage of this accessory due to safety concerns with respect to minimum water depths. A buoy system may also be provided to identify an area for swimmers to stay out of while a climber is attempting to climb the wall. The increased height of the climbing wall would require an increase in the minimum water depth. The height extension panel would be removable in the event that a lower climbing wall is again desired. Sprinkler fittings may be mounted to the top panel or framework providing for the added thrill of climbing in a simulated waterfall. A pump and hose system may be mounted to the framework and climbing wall surface.

In one embodiment, the artificial rock climbing system is adapted for removable attachment to a support surface adjacent a body of water. The system and methods comprise a generally rigid framework with a climbing surface mounted between the framework, a pair of receivers for hindedly coupling the framework to the support surface, a pair of adjustable support bars coupled between the framework and the receivers, the support bars adapted for positions including a locked, climbing position, and an unlocked, collapsed non-use position, and a pair of assist members for assisted lifting and/or lowering of the framework.

In an additional embodiment, systems and methods of raising and/or lowering an artificial rock climbing wall system are provided. One embodiment of a method comprises providing an artificial rock climbing wall adapted for removable attachment to a support surface adjacent a body of water, the rock climbing wall including positions between a lowered non-use position and a raised climbing position, and activating an assist member for assisted raising and/or lowering of the rock climbing wall, the assist member positioned between the rock climbing wall and the support surface.

Various other objects, features and advantages for the invention will be made apparent from the following description taken together with the drawings.

BRIEF DESCRIPTION OF THE DRAWINGS

The drawings illustrate the best mode presently contemplated of carrying out the invention.

DESCRIPTION OF THE PREFERRED EMBODIMENT

Figure 1:
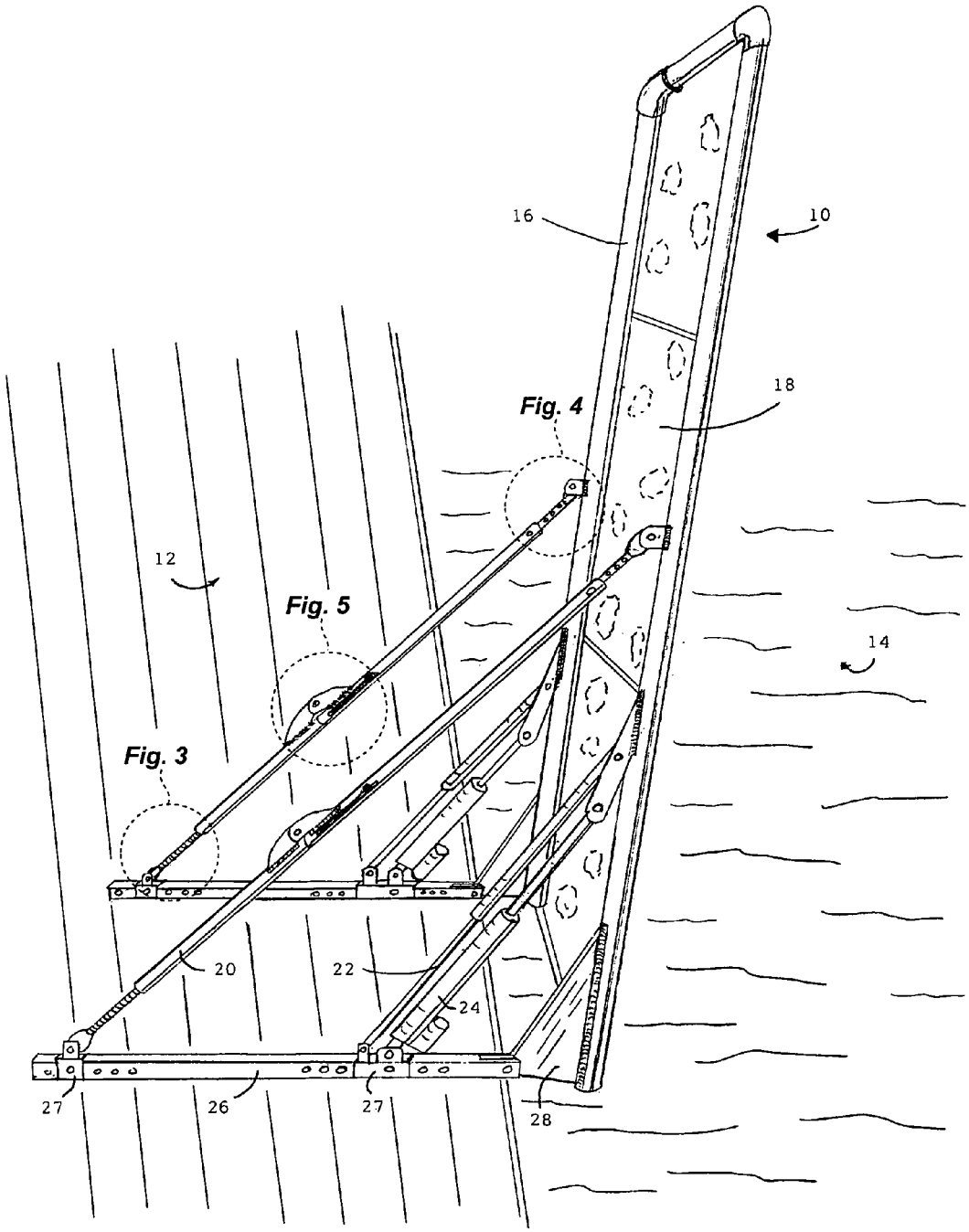
FIG. 1 is a perspective view of an artificial rock climbing arrangement pivotally attached to the edge of a support surface located adjacent a body of water showing parallel diagonal support bars, assist shocks, and actuators.

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Referring now to the drawings, FIG. 1 through FIG. 11 illustrate embodiments of an artificial rock climbing arrangement 10 which may be removably attached to a support surface in the form of a pool deck 12, for example, located adjacent a body of water 14. The rock climbing arrangement 10 may be comprised of a generally rigid framework 16, a modular panel structure 18 mounted on or between the framework 16, a pair of diagonal support bars 20 between the framework 16 and the pool deck 12 for maintaining the framework 16 and panel structure 18 in a substantially vertical climbing orientation (locked) and an easily collapsed non-use position (unlocked), a pair of assist members, i.e., shocks 22 (gas, spring, hydraulic, air or other) for assisted lifting and/or lowering, a pair of actuators 24 (electric, hydraulic, or other) for motorized or power-up lifting and/or lowering, and a pair of tubular receivers 26 for hindedly coupling the bottom of the framework 16 and triangular plate 28 to the edge of the pool deck 12. Also, the diagonal support bar 20, assist shocks 22, and actuators 24 are adjustably mounted to the tubular receivers 26 using various shaped couplings 27.

Figure 11:
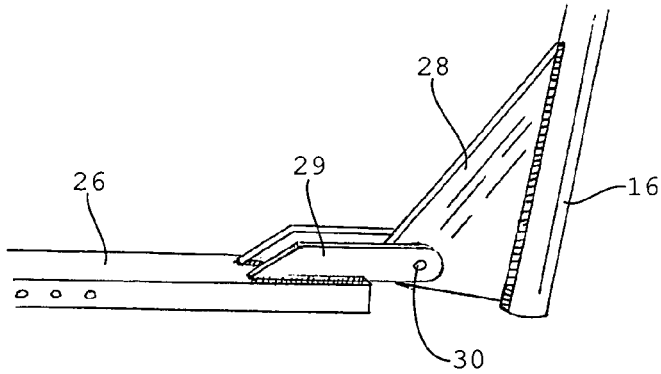
FIG. 11 is a perspective view of an alternative mounting configuration for the climbing wall to mount to the support structure.

FIG. 11 depicts an alternative configuration for hingedly coupling a receiver 26 to the framework 16. As can be seen, bracket 29 may be coupled to the receiver 26, with a retaining pin 30 hingedly coupling the bracket 29 to the triangular plate 28 and the framework 16.

Figure 2:
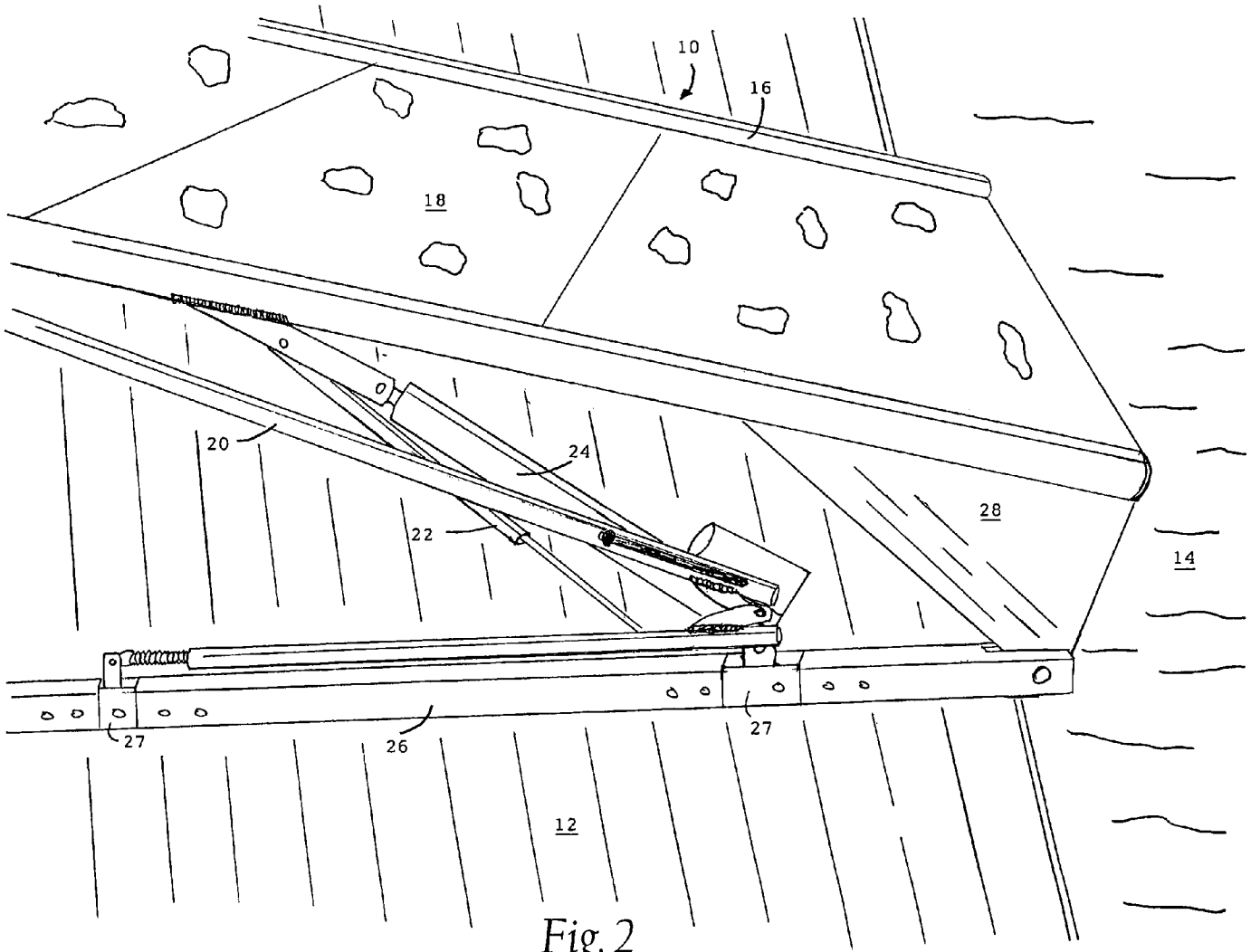
FIG. 2 is a view like FIG. 1 showing the artificial rock climbing arrangement in a collapsed, non-use position.

FIG. 2 depicts the rock climbing arrangement 10 pivoted downward to a non-use position along with the diagonal support bars 20, assist shocks 22, and actuator 24 in a folded or collapsed non-use position. The non-use position may be defined by the framework 16 and the climbing structure folded rearwardly and downwardly to a horizontal or near horizontal level on top of the pool deck 12 after the diagonal support bars 20 have been unlocked.

Figure 3:
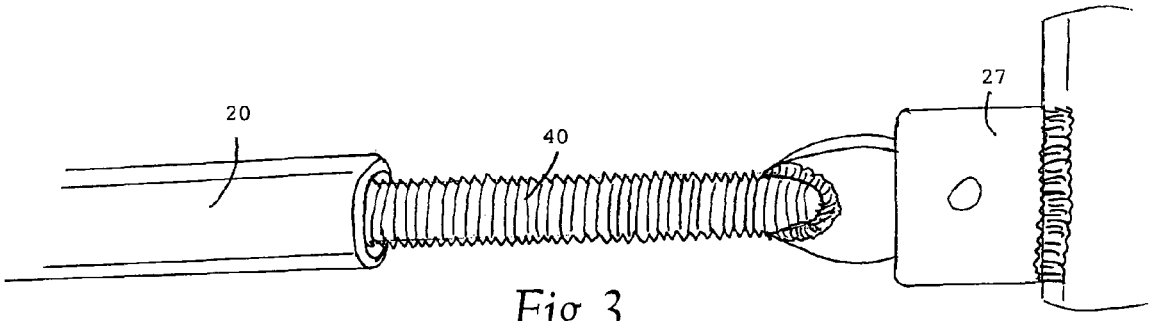
FIG. 3 is a close-up view showing the threaded end of the diagonal support bar as seen in FIG. 1.
Figure 4:
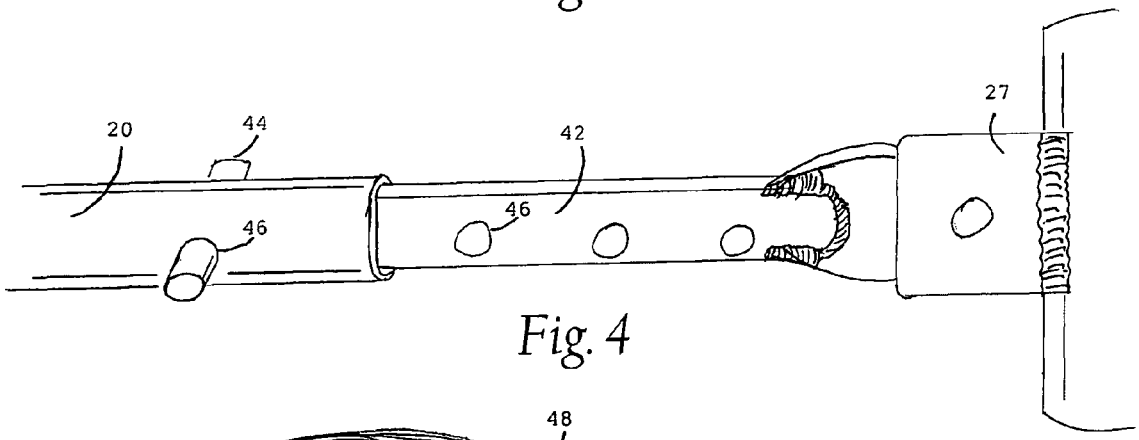
FIG. 4 is a close-up view showing the telescoping end of the diagonal support bar as seen in FIG. 1.
Figure 5:
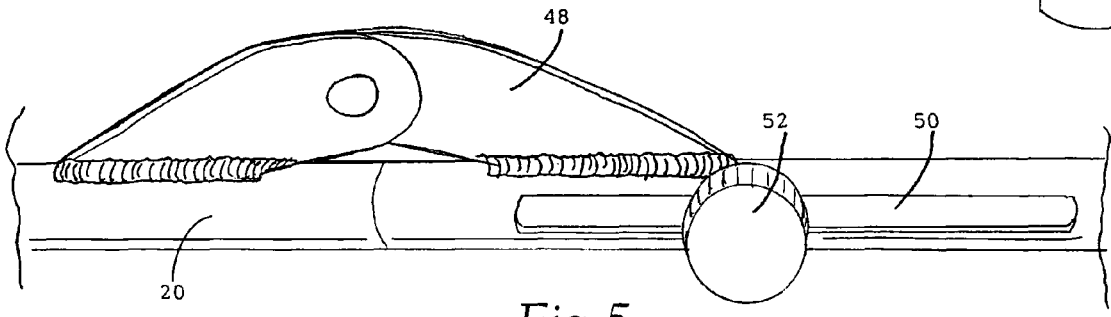
FIG. 5 is a close-up view showing the hinged section of the diagonal support bar as seen in FIG. 1.

FIGS. 3, 4, and 5 depict close-up views of possible elements of the diagonal support bars. FIG. 3 shows one end of the diagonal support bar 20 having a threaded coupling 40 which may be used to allow for small adjustments in the length of the diagonal support bar 20. Rotational movement of the threaded coupling 40 will lengthen or shorten the overall length of the diagonal support bar 20. FIG. 4 shows one end of the diagonal support bar 20 having a telescoping coupling 42 which may be used to allow for large adjustments in the length of the diagonal support bar 20. A retaining pin 44 may be inserted through an aperture 46 located in both the diagonal support bar 20 and telescoping coupling 42. Lateral movement of the telescoping coupling 42 along with the removal and subsequent insertion of the retaining pin 44 will lengthen or shorten the overall length of the diagonal support bar 20. FIG. 5 shows a hinge system 48 which allows the diagonal support bar 20 to maintain a rigidly straight or extended position and to allow the diagonal support bar 20 to maintain a collapsed or folded position. In order for the diagonal support bar 20 to maintain a rigidly straight or extended position, pressure may be placed on knob 52 of locking pin 50 and locking pin 50 may be slidably equally received inside both halves of the diagonal support bar 20. When reverse pressure is placed knob 52 of the locking pin 50 and the locking pin 50 is completed received inside one-half of the diagonal support bar 20, the centrally located hinge system 48 may be allowed to pivot freely and provide for a folded or collapsed position.

Figure 6:
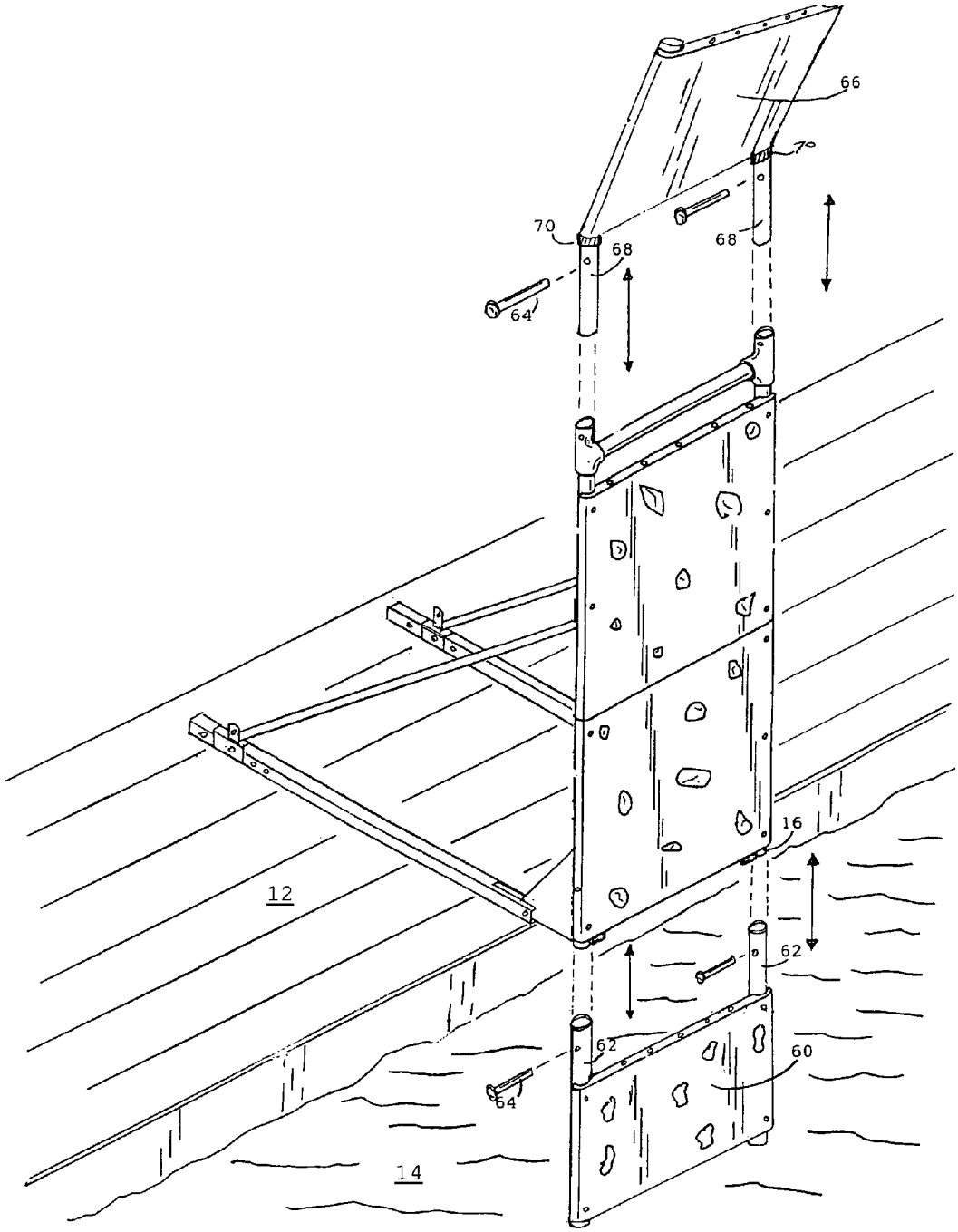
FIG. 6 is a perspective view like FIG. 1, showing the artificial rock climbing arrangement showing a removable anti-climb-over panel and removable water start panel.

FIG. 6 depicts a removable water-start panel 60 and a removable anti-climb-over panel 66. The water-start panel 60 may be mounted to a pair of tubular frames 62 which may be received by the main framework legs 16 of the overall climbing structure. The tubular frames 62 may be locked in place by inserting retaining pin 64 through an aperture in the framework legs 16 and a matching aperture in the tubular frames 62. The water-start panel 60 and tubular frames 62 may be partially submerged in the water 14. The water-start panel may be used to provide for an easier and safer climbing position. The anti-climb-over panel 66 may be mounted to a pair of tubular frames 68 which may be received by the main framework legs 16 of the overall climbing structure. The tubular frames 68 may be locked in place by inserting retaining pin 64 through an aperture in the framework legs 16 and a matching aperture in the tubular frames 68. The anti-climb-over panel may be used to prohibit climbing over the wall. Climbing holds may not be mounted to the anti-climb-over panel. The tubular frames 68 may include an angle of bend approximating 20 degrees, for example, although the angle may be more or less. The tubular frames 68 may include a round collar 70 near the angle of bend in order to provide a slide stop.

Figure 7:
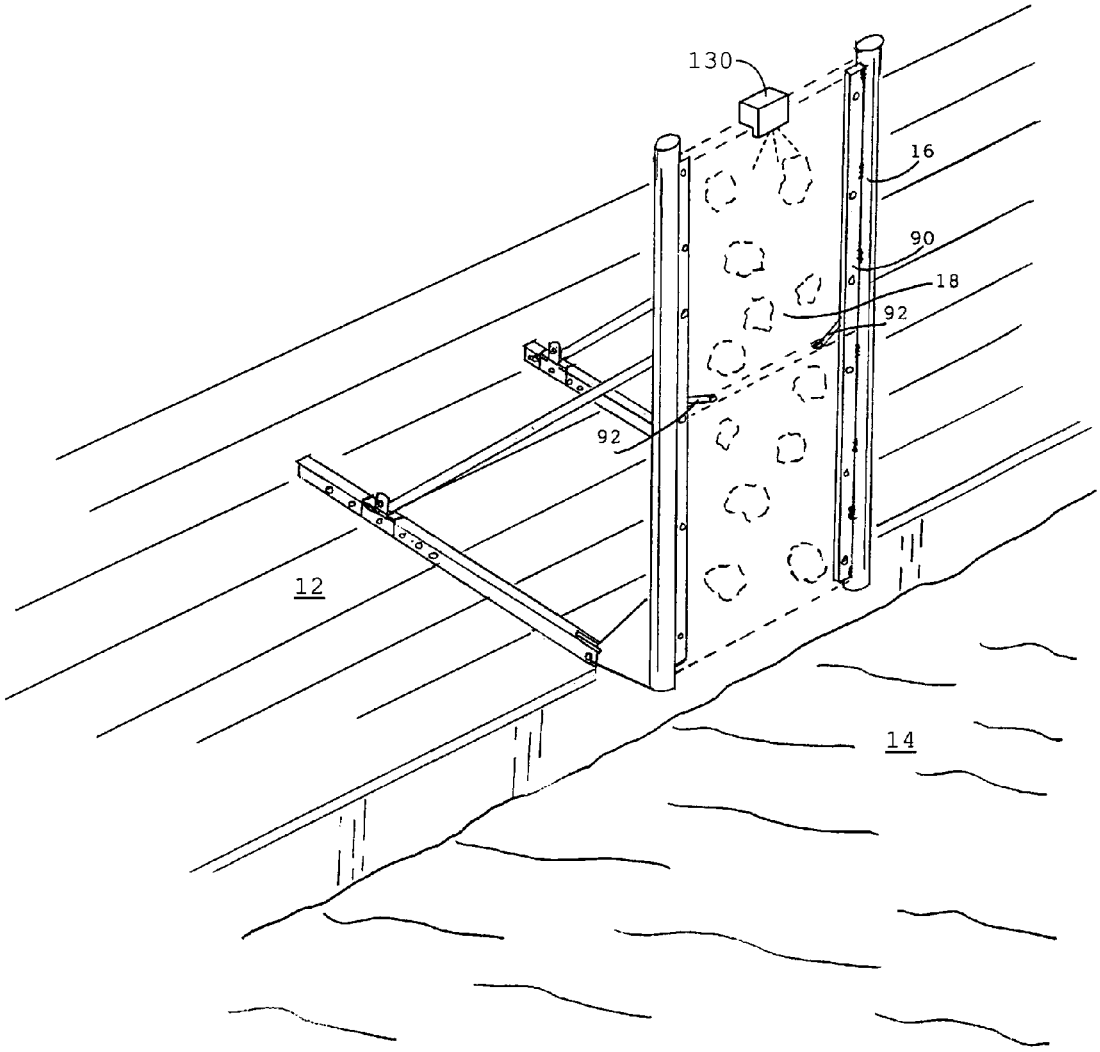
FIG. 7 is a perspective view like FIG. 1, showing the artificial rock climbing arrangement showing a panel mount inner lip welded onto the inside edge of the framework legs with sway bar supports and without the U-shape and bight portion.

FIG. 7 depicts an alternative modular panel structure 18 mounting system. Whereby, a lip 90 may be welded to the inside edges of the main framework legs 16. The modular panel structure 18 may be mounted to the lip 90 by drilling holes in the modular panel structure 18 and lip 90 and affixing through bolts and retaining nuts, for example. A sway bar support 92 may be affixed to the rear side of the main framework legs 16 and the rear side of the modular panel structure 18 at the flange in order to prohibit rotational movement of the main framework legs 16. FIG. 7 also shows the use of a water-fall/sprinkler accessory system 130.

Figure 8:
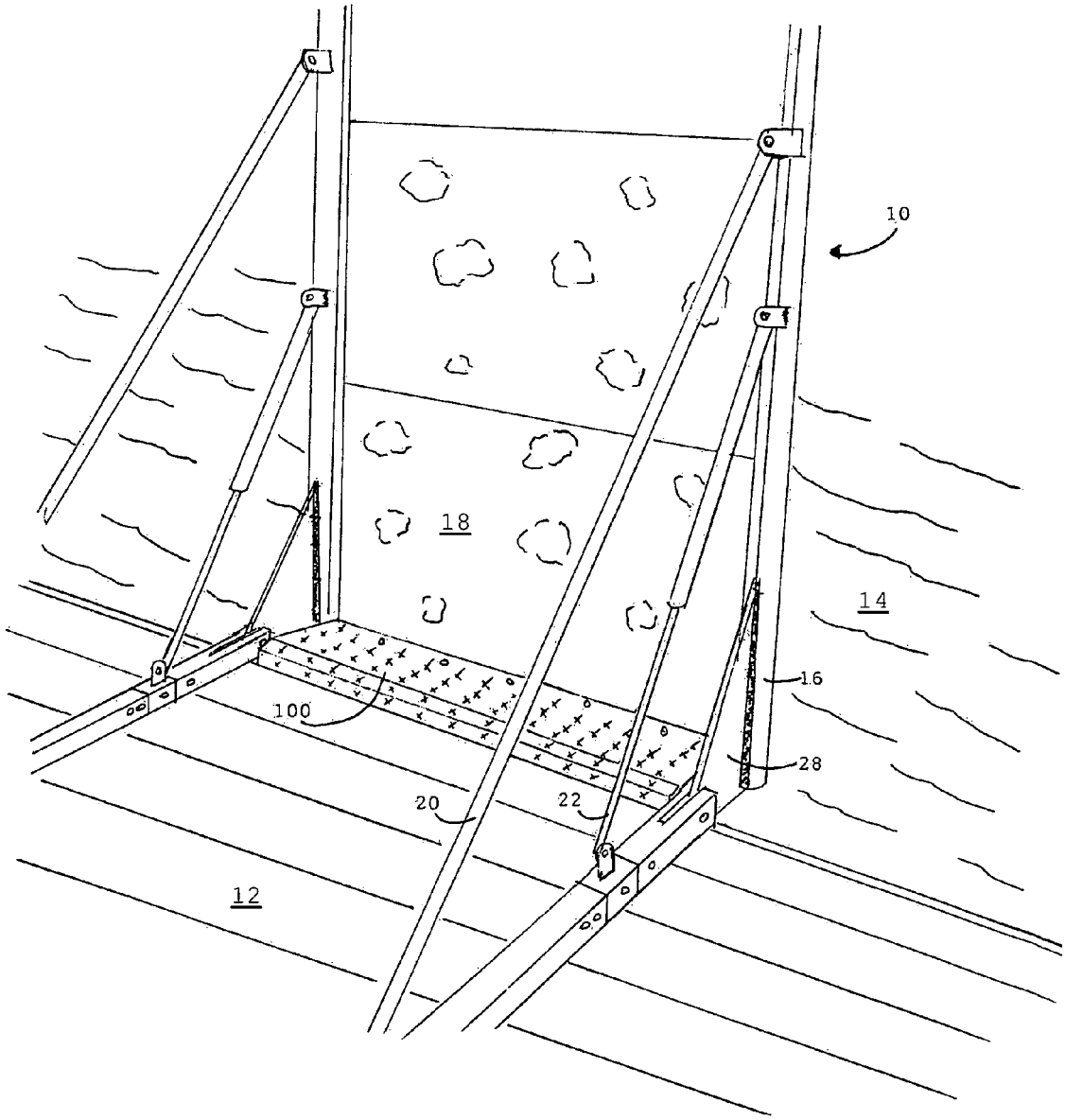
FIG. 8 is a perspective view like FIG. 1, showing the artificial rock climbing arrangement showing an anti-entrapment shield mounted to the lower rear portion of the framework legs and panel system.

FIG. 8 is a partial view of an artificial rock climbing arrangement 10, which depicts an anti-entrapment shield 100 mounted to the lower rear portion of the framework legs 16, triangular plate 28, and the lower flange of modular panel structure 18. The anti-entrapment shield 100 may or may not rest on the support surface or pool deck 12.

Figure 9:
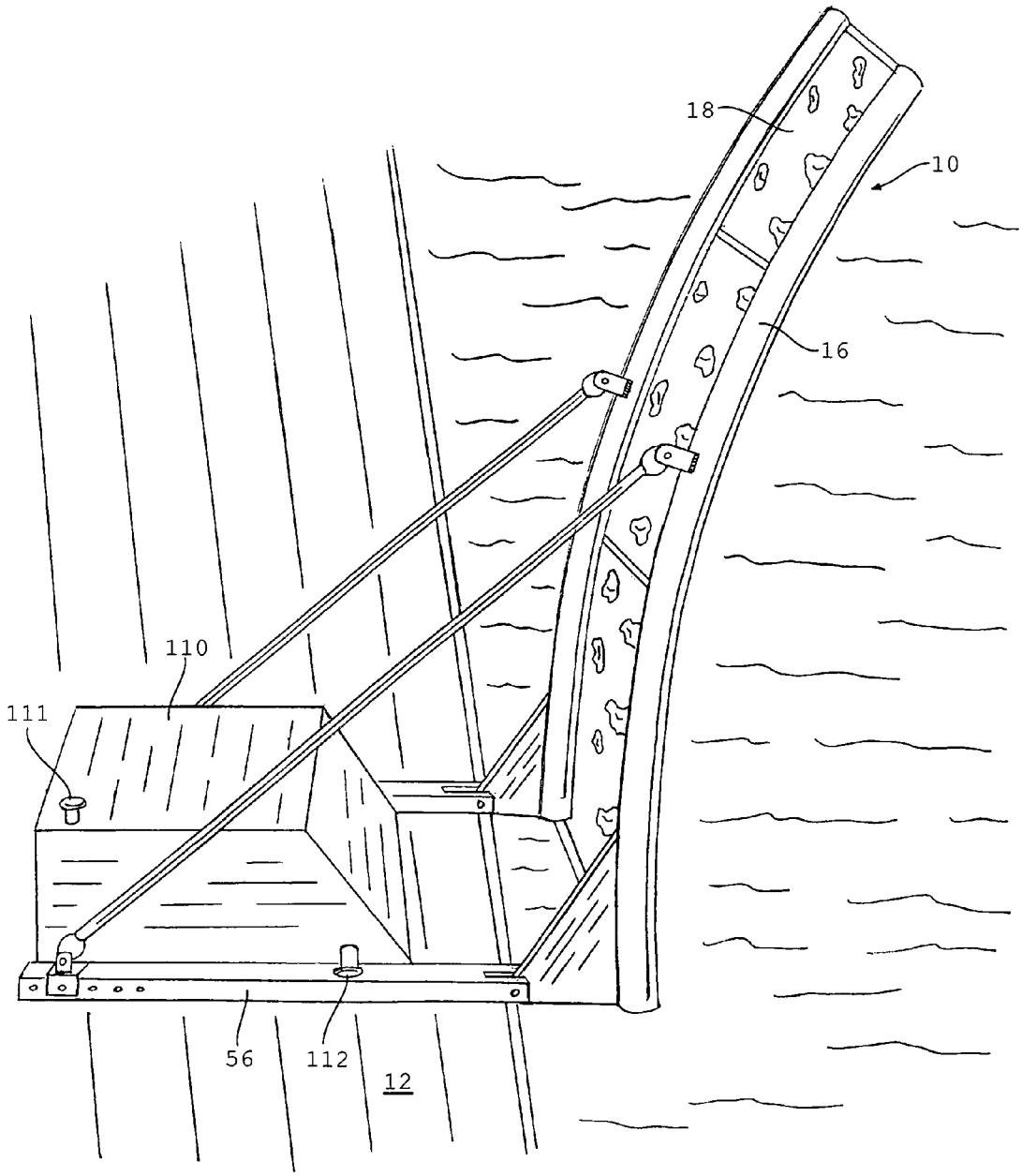
FIG. 9 is a perspective view like FIG. 1, showing an alternative C-Shape to the framework legs and climbing wall surface, and in addition, a non-fixed counter-weight ballast system attached to the base of the rock climbing arrangement.

FIG. 9 depicts the rock climbing arrangement 10 having an alternative panel structure 18 and an alternative framework 16 forming a C-Shape to the climbing surface. It is to be appreciated that additional non-linear shapes are also possible for the panel structure 18 and framework 16. Additional framework and climbing surface shapes may include partial non-linear portions, or the framework and climbing surfaces may be a continuous non-linear shape.

FIG. 9 also depicts the rock climbing arrangement 10 having an alternative ballast counter-weight tank enclosure 110 releasably fastened to the rear portion of the tubular receivers 26, which may, in combination, rest on the support surface or pool deck 12 with no mounting bolts or fasteners. The tank enclosure 110 shows a fill cap 111 and a discharge valve 112 in order to fill and empty the tank enclosure 110.

Figure 10:
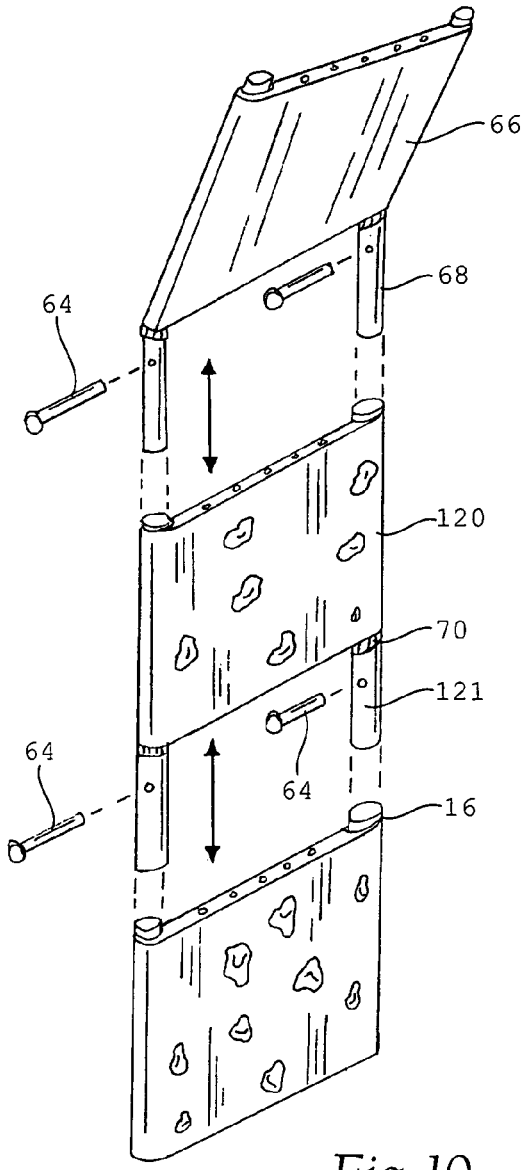
FIG. 10 is a perspective view like FIG. 6, showing a removable climbing wall height extension panel.

FIG. 10 depicts a removable height extension panel 120. The removable height extension panel 120 may be mounted to a pair of tubular frames 121 which are received by the main framework legs 16 of the overall climbing structure. The tubular frames 121 may be locked in place by inserting retaining pin 64 through an aperture in the framework legs 16 and a matching aperture in the tubular frames 121. The anti-climb over panel 66 along with the tubular frames 68 may then be mounted and received by the tubular frames 121 of the height extension panel 120. Again, the tubular frames 68 are locked in place by inserting retaining pin 64 through an aperture in the tubular frames 121 and a matching aperture in the tubular frames 68. The removable height extension panel may be used to increase the overall height of the climbing wall. The tubular frames 121 may include a round collar 70 near the bottom edge of the removable height extension panel 120 in order to provide a slide stop.

The foregoing is considered as illustrative only of the principles of the invention. Furthermore, since numerous modifications and changes will readily occur to those skilled in the art, it is not desired to limit the invention to the exact constructions and operations shown and described. While the preferred embodiment has been described, the details may be changed without departing from the invention, which is defined by the claims.

I claim:

1. An artificial rock climbing system comprising:

a generally rigid framework removably attached to a support surface located adjacent a body of water, the framework comprising a pair of independent and parallel legs connected together by a panel structure, the panel structure defining a climbing surface and carrying a plurality of climbing holds, each framework leg including a mounting device removably secured to the support surface, the mounting device comprising a knuckle coupled to the framework leg, independent and parallel mounting tubes removably attached to the top of the support surface, each mounting tube including a receiver, with the receiver being hingedly coupled to the knuckle, at least one mounting tube including an adjustably mounted coupling, the at least one adjustably mounted coupling adapted to secure an assist member to the mounting tube, and adjustable and lockable hinged diagonal support structure secured between the framework and the mounting tube attached to the top of the support surface, the support structure for maintaining the framework and the climbing surface in a climbing orientation when a climber scales the climbing surface, and for maintaining the framework and climbing surface in a collapsed, non-use orientation.

2. The rock climbing system of claim 1:

wherein the mounting device and the assist member permits pivotal movement of the framework and the climbing surface relative to the support surface.

3. The rock climbing system of claim 1:

wherein the panel structure comprises a clear polycarbonate material adapted to allow users and observers to see through the climbing surface while the user is climbing.

4. The rock climbing system of claim 1:

wherein a removable hinge pin is passed through the knuckle and the receiver.

5. The rock climbing system of claim 1:

wherein the framework removably receives an independent framework for an anti-climb-over panel.

6. The rock climbing system of claim 1:

wherein the framework removably receives an independent framework for a water-start panel.

7. The rock climbing system of claim 1:

wherein the framework is adapted to removably receive an independent lockable telescoping framework for extending the height of the overall framework whereby at least one additional climbing panel can be attached.

8. The rock climbing system of claim 1:

wherein the framework includes an inner lip or C-channel to slide or securely fasten the panel structure.

9. The rock climbing system of claim 1:

wherein the framework includes at least one of an assist shock and an actuator mounted between the framework leg and mounting tube for assisted and/or automated pivotal movement of the framework.

10. The rock climbing system of claim 1:

wherein the panel structure is modular and includes at least two adjacent panels removably fastened to the independent and parallel legs.

11. The rock climbing system of claim 8:

wherein the panel structure comprises top and bottom flanged horizontal edges and right and left flat vertical edges fixed to the framework leg lip or C-channel.

12. The rock climbing system of claim 1:

wherein the lower end of the framework legs and panel structure include an anti-entrapment shield.

13. The rock climbing system of claim 1:

wherein the adjustable and lockable hinged diagonal support structure includes at least one adjustable coupling for lengthwise adjustment.

14. The rock climbing system of claim 1:

wherein the adjustable and lockable hinged diagonal support structure is adjustable between positions for holding the framework and climbing surface at an angle of substantially 90 degrees relative to the support surface, and at angles greater than 90 degrees relative to the support surface.

15. The rock climbing system of claim 1:

further including a sprinkler system coupled to the climbing wall.

16. The rock climbing system of claim 1:

further including a fillable ballast counter-weight releasably fastened to the mounting tubes.

* * * * *